US007740197B1

(12) United States Patent
Schulz

(10) Patent No.: US 7,740,197 B1
(45) Date of Patent: Jun. 22, 2010

(54) GARBAGE DISPOSAL GUARD

(76) Inventor: Victor V. Schulz, 1209 Willow Pond Dr., Waite Park, MN (US) 56387

( * ) Notice: Subject to any disclaimer, the term of this patent is extended or adjusted under 35 U.S.C. 154(b) by 1035 days.

(21) Appl. No.: 11/450,207

(22) Filed: Jun. 9, 2006

Related U.S. Application Data

(60) Provisional application No. 60/691,066, filed on Jun. 16, 2005.

(51) Int. Cl.
*B02B 1/00* (2006.01)
*B02C 11/08* (2006.01)
*B07B 4/00* (2006.01)

(52) U.S. Cl. ..... 241/46.015; 241/46.016

(58) Field of Classification Search ..... 241/46.015, 241/46.016
See application file for complete search history.

(56) References Cited

U.S. PATENT DOCUMENTS

| | | | | |
|---|---|---|---|---|
| 2,236,885 | A | 4/1941 | Zinkil et al. | |
| 2,244,402 | A | 6/1941 | Powers | |
| 2,544,498 | A | 3/1951 | Hiertz | |
| 2,793,373 | A | 5/1957 | Ewing | |
| 2,948,482 | A * | 8/1960 | Jordan | 241/46.015 |
| 2,953,308 | A | 9/1960 | Isola | |
| 2,980,351 | A * | 4/1961 | Greene | 241/46.016 |
| 3,161,360 | A * | 12/1964 | Levine | 241/46.016 |
| 3,449,775 | A | 6/1969 | Krauze | |
| 3,702,013 | A | 11/1972 | Gebert | |
| 3,742,524 | A | 7/1973 | Ballentine | |
| 3,742,525 | A | 7/1973 | Oropallo | |
| 3,745,594 | A | 7/1973 | Cosper | |
| 3,788,485 | A | 1/1974 | Bruning | |
| 3,854,151 | A | 12/1974 | Boudewyn | |
| 3,982,289 | A | 9/1976 | Robbins | |
| 4,138,747 | A | 2/1979 | Zijlstra | |
| 4,161,043 | A | 7/1979 | Flores | |
| 4,164,796 | A | 8/1979 | Sakow | |
| 4,321,713 | A | 3/1982 | Thompson | |
| 4,329,744 | A | 5/1982 | Cuschera | |
| 4,443,897 | A | 4/1984 | Austin | |
| 4,519,102 | A * | 5/1985 | Efstratis | 4/292 |
| 4,752,035 | A | 6/1988 | Felder | |
| 4,883,590 | A | 11/1989 | Papp | |
| 4,910,811 | A | 3/1990 | Izzi, Sr. | |
| 5,271,108 | A * | 12/1993 | Wicke | 4/629 |
| 6,000,643 | A * | 12/1999 | Gelder | 241/37.5 |
| 6,735,791 | B1 * | 5/2004 | Lordahl et al. | 4/292 |
| 7,264,188 | B2 | 9/2007 | Anderson et al. | |
| 7,533,836 | B2 * | 5/2009 | Pan | 241/46.016 |

OTHER PUBLICATIONS

"General Requirements for All Machines", OSHA Regulations, 29 CFR 1910.212, 1 page.

* cited by examiner

*Primary Examiner*—Bena Miller

(57) ABSTRACT

An embodiment of a garbage disposal guard is comprised of a cylindrical sleeve having an outside diameter less than the inside diameter of the throat of a garbage disposal; a lip extending outward from the cylindrical sleeve, a lip having an outside diameter greater than the inside diameter of the throat of the garbage disposal; and bars extending between points on the inside diameter of the cylindrical sleeve that form a grate.

8 Claims, 7 Drawing Sheets

GARBAGE DISPOSAL GUARD

CROSS REFERENCE TO RELATED APPLICATION

This application claims the benefit of U.S. Provisional Patent Application No. 60/691,066 entitled "GARBAGE DISPOSAL GUARD" as filed on Jun. 16, 2005.

BACKGROUND

1. Field of the Technology

The field of the technology described in this specification relates to protective guards for home and commercial garbage disposals.

2. Introduction

Garbage disposals 7 are a staple of modern life. Typically one thinks of garbage disposals 7 for the home. But disposals 7 are extensively used in the food industry where great quantities of food must be disposed of quickly. Examples of food industries range from school and restaurant kitchens to food preparation businesses, such as frozen or nonfrozen food manufacturers, butcher shops, and even meat packers where unusable portions of the meat must be disposed.

Disposals 7 generally have a rubber insert in their throats 8A to stop the disposal's contents from being spun out of the throat 8A onto the surrounding area and people. However, throat 8A of a home-user garbage disposal 7 is of a size that allows the insertion of an adult hand.

In retail and industrial food preparation establishments, garbage disposal 7 capacity is larger than those used in the home. Consequently, its throat 8A is larger than that for home use, making the danger of hand insertion even greater.

This hazard is avoided with use of the garbage disposal guard 1 described herein.

In the following description of the embodiments like numerals refer to like elements.

DESCRIPTION OF THE EMBODIMENTS

Guard 1 fits into the throat 8A of a sink mounted garbage disposal 7 to protect the user from accidental injury due to the motorized rotation of the disposal's grinder. Guard 1 also substantially reduces water splash-back emanating from inside operating disposal 7. The embodiment of guard 1 described herein is virtually indestructible and simple to use.

Embodiments of guard 1 are shown in FIGS. 1-7.

Guard 1 is comprised of, as shown in FIGS. 1, 2, 3, and 4, cylindrical sleeve 2A having an outside diameter 2B less than inside diameter 8B of throat 8A of disposal 7; lip 3A extending outward from cylindrical sleeve 2A, lip 3A having an outside diameter 3B greater than inside diameter 8B of throat 8A of disposal 7; and bars 4A and 4B extending between points on inside diameter 2C of cylindrical sleeve 2A.

Cylindrical sleeve 2A of guard 1 fits within throat 8A of disposal 7. Cylindrical sleeve 2A is generally vertically disposed in throat 8A of disposal 7 or nearly so, depending upon the configuration of the disposal's throat 8A. The outside diameter 2B of cylindrical sleeve 2A is approximately the size of the inner diameter 8B of disposal throat 8A and is substantially coaxial with throat 8A of disposal 7. A removable, but tight fit between outside diameter 2B of cylindrical sleeve 2A and inside diameter 8B of throat 8A of disposal 7 is desirable because it limits lateral movement of cylindrical sleeve 2A within throat 8A.

Figure 1:
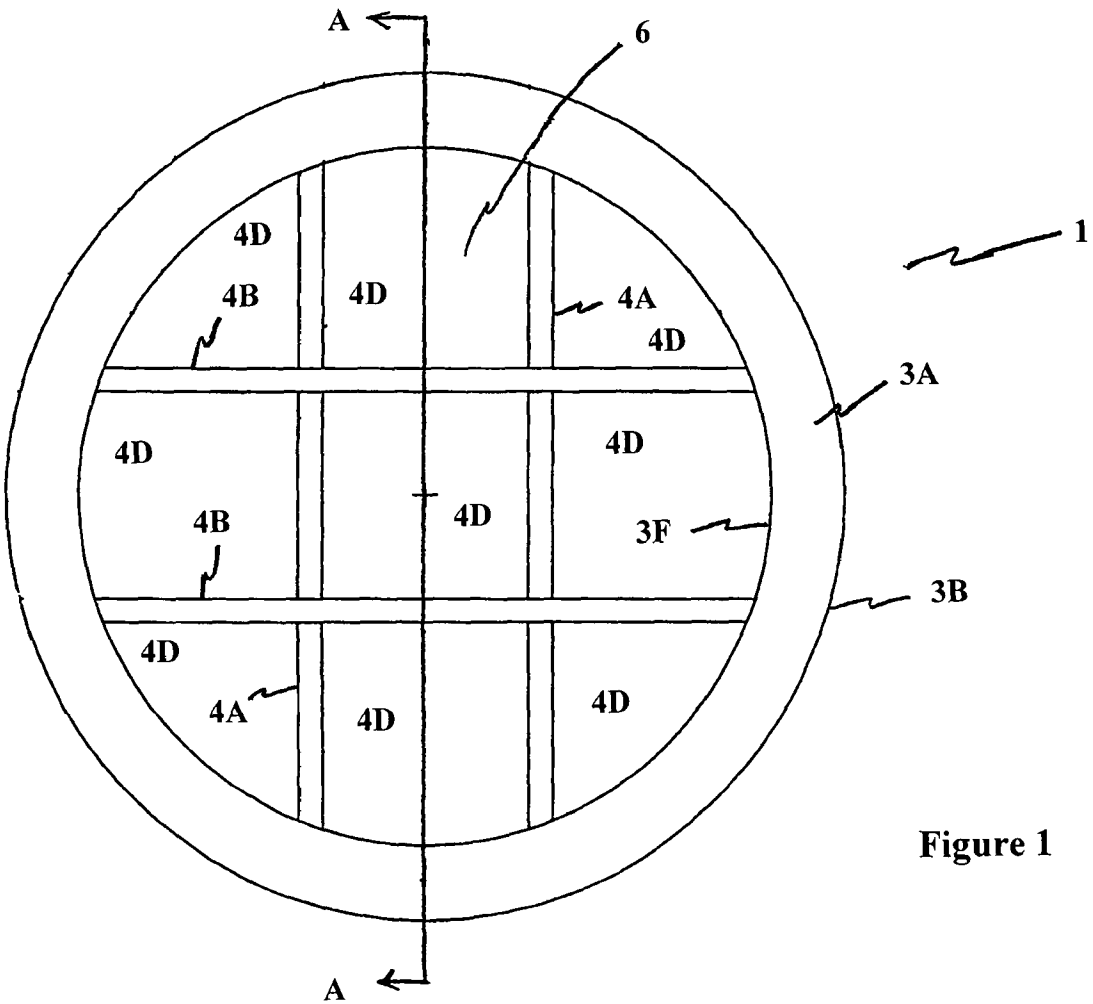
FIG. 1 is a top plan view of an embodiment of guard 1.
Figure 2:
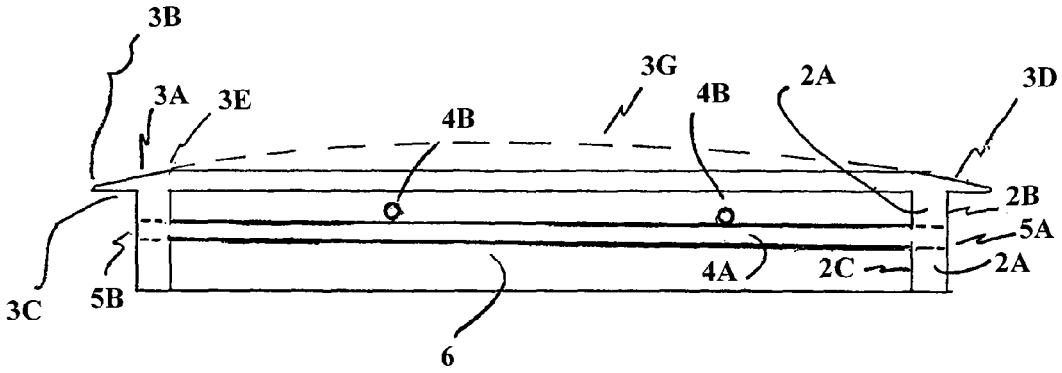
FIG. 2 is a cross-sectional view of guard 1 taken along line A-A of FIG. 1.
Figure 4:
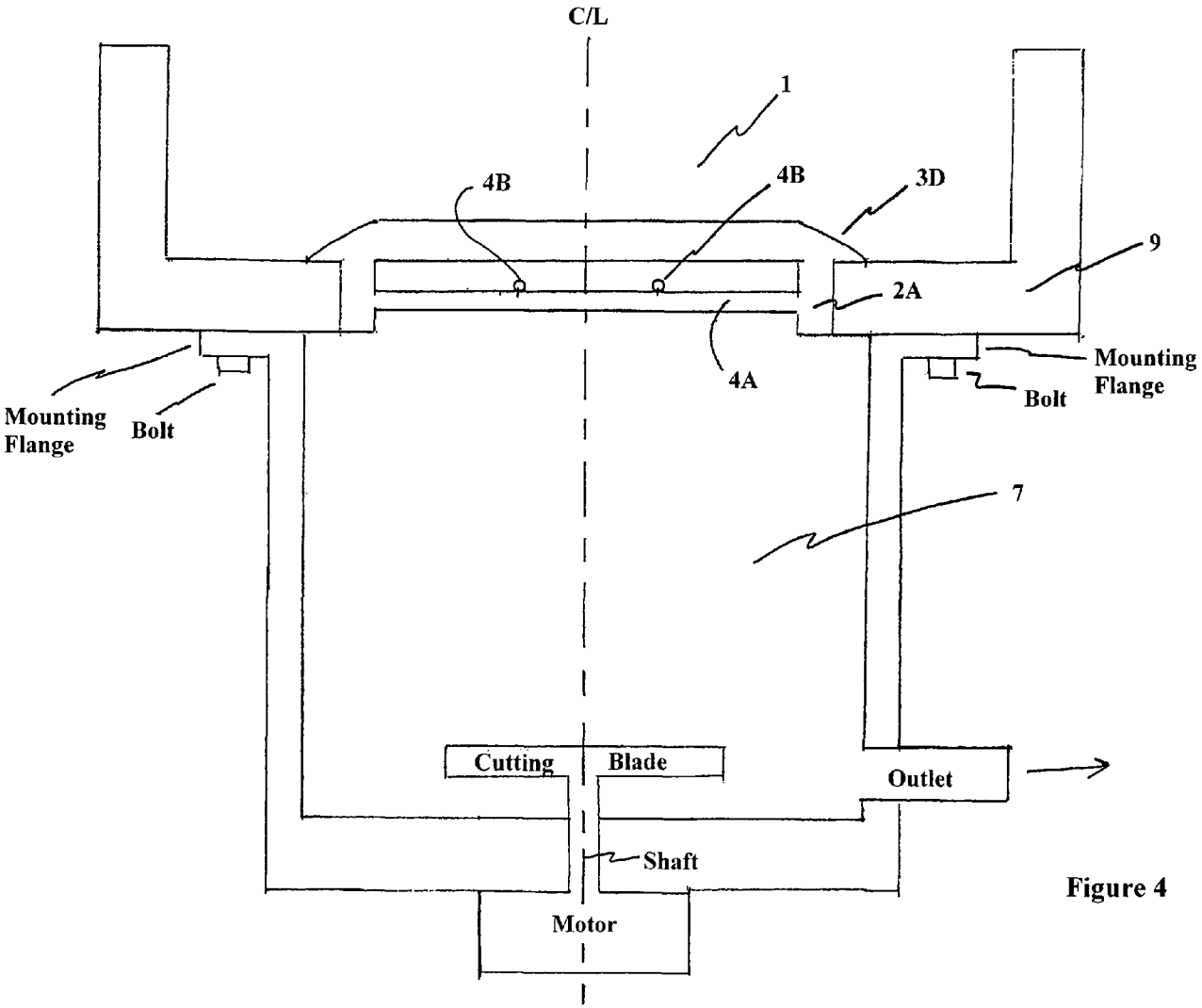
FIG. 4 is a cross-sectional view of an embodiment of guard 1 in the throat 8A of disposal 7 which is fitted into sink 9.
Figure 7:
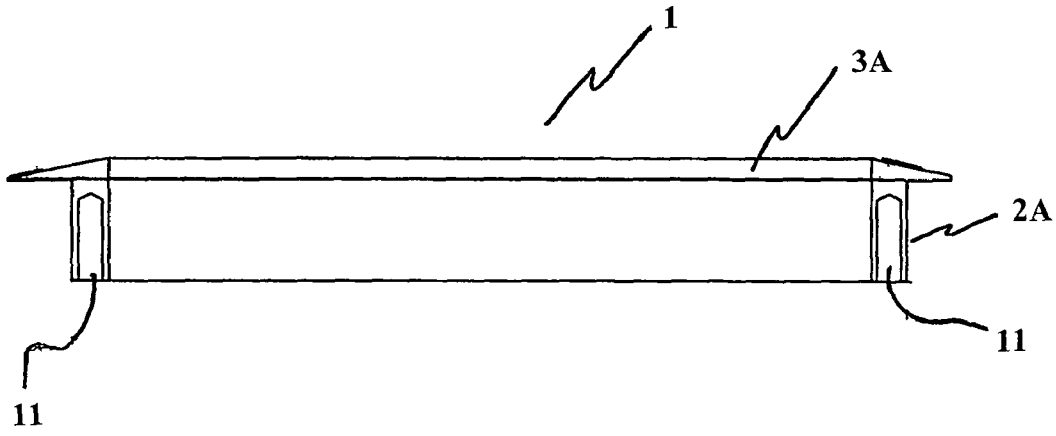
FIG. 7 is a cross-sectional view of an embodiment of guard 1 taken along line A-A of FIG. 1, with tapped holes for fastening lip 3A.

Lip 3A surrounds cylindrical sleeve 2A. Lip 3A is best illustrated in FIG. 2, a cross-section taken along line A-A of FIG. 1. Lip 3A flares out from cylindrical sleeve 2A and away from the throat 8A of disposal 7. Lip 3A has a diameter that allows it to be supported by either an outer portion of garbage disposal 7 or by the surface surrounding disposal 7, which is most likely sink 9. Bottom 3C of lip 3A abuts the top surface of the bottom of sink 9 (FIG. 4). Top 3D of lip 3A is curved. It is defined by radius 3G. Radius 3G makes a smooth transition from its inside diameter 3F to its outer diameter 3B where it meets the sink 9 surface elevation. An embodiment of top 3D of lip 3A is angled upward from outside diameter 3B of lip 3A to termination point 3E of lip 3A at inside diameter 2C of cylindrical sleeve 2A. An embodiment of guard 1 is shown in FIG. 7. Guard 1 is fastened with threaded screws through, for example, the bottom side of sink 9 or disposal 7 and into tapped holes 11 in the bottom of lip 3A to deter the user from removing guard 1. Six tapped holes equally spaced could be used, for example. The top face of lip 3A may be embossed or etched with a warning against removal, model number, serial number, and logo.

An embodiment of guard 1 may be comprised of one or more bar(s) 4A each of which extend across inside diameter 2C of cylindrical sleeve 2A. Where there is more than one bar 4A, none of bars 4A intersect any other bar 4A. Another embodiment of guard 1 may be comprised of one or more bar(s) 4B, as well as one or more bar(s) 4A. (FIGS. 1-4) Each of bar(s) 4B extend across inside diameter 2C of cylindrical sleeve 2A. Where there is more than one bar 4B, none of bars 4B intersect any other bar 4B. Bar(s) 4B intersect bar(s) 4A, thereby forming a criss-cross pattern of bar(s) 4A and 4B.

Figure 3:
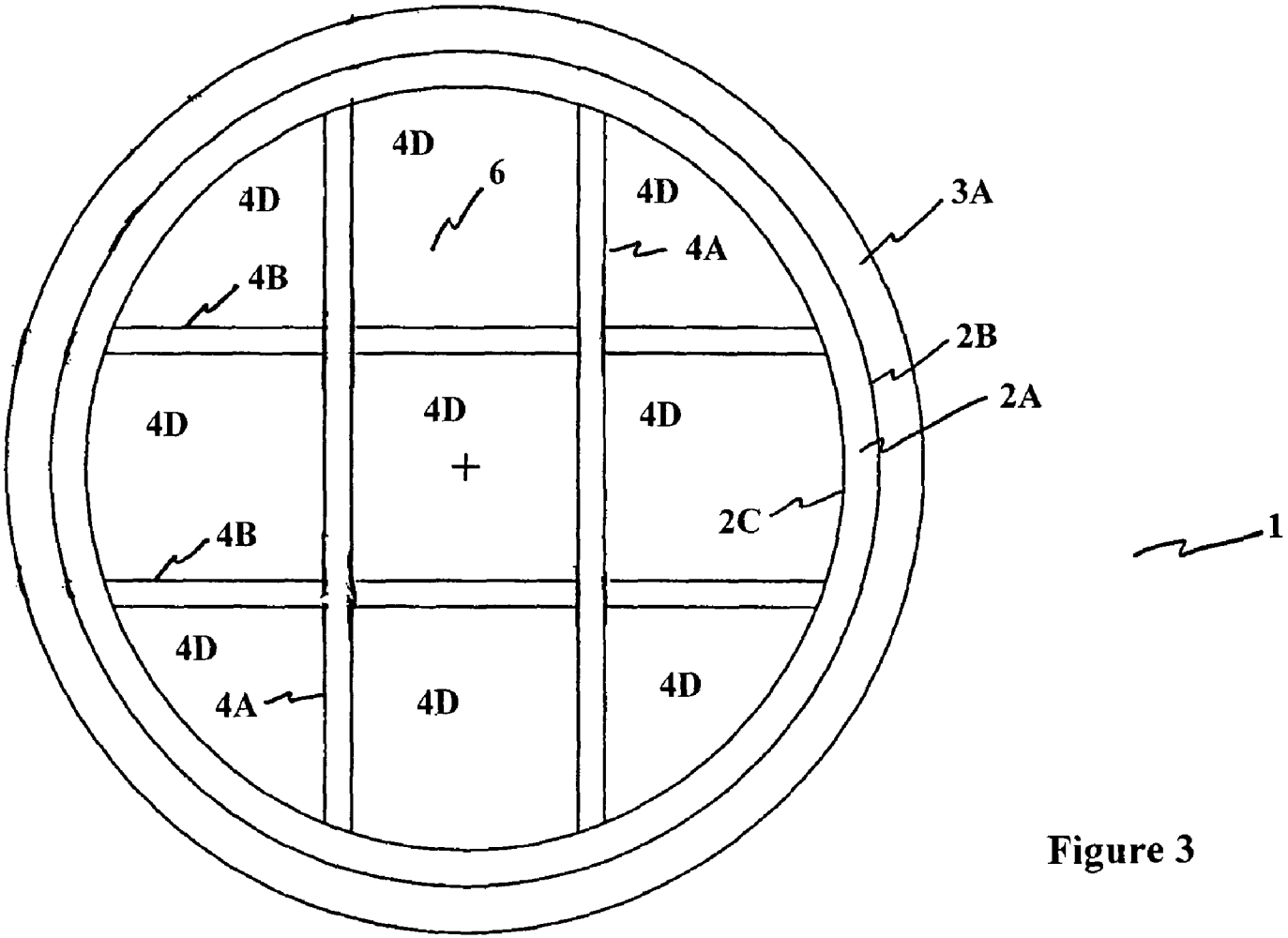
FIG. 3 is a bottom plan view of guard 1 of FIG. 1.

Bar(s) 4A and 4B extend from a point on inside diameter 2C of cylindrical sleeve 2A, across throat 6 of guard 1, and to another point on inside diameter 2C of cylindrical sleeve 2A. Bar(s) 4A and 4B may each be continuous bars disposed within cylindrical sleeve 2A so they criss-cross one another to form a grate 4C. In an embodiment of guard 1 (FIG. 6), bar(s) 4A and 4B are arrayed in a flat planar grate 4C so all of bar(s) 4A and 4B are in a single plane, instead of bar(s) 4A and 4B criss-crossing. In both the criss-cross grate 4C and the flat planar grate 4C, the size of open portion 4D of grate 4C must ensure that hands cannot penetrate into the cutting/grinding portion of garbage disposal 7. The flat planar grate 4C helps avoid food collecting in the spaces where bar(s) 4A and 4B criss-cross over or under, as the case may be, each other (FIGS. 1-3). Guard 1 may have any number of bar(s) 4A and 4B. Bars 4A and 4B may be constructed of round, flat, diagonal, or other shaped material.

Besides showing bar(s) 4A criss-crossing bars 4B, FIG. 2 also shows insertion apertures 5A and 5B (dotted lines) wherein the ends of bars 4A and 4B are lodged. Each of bars 4A and 4B shown in this embodiment are inserted through a bar insertion aperture 5A or 5B, across throat 6 of guard 1, and through another in-line bar insertion aperture 5A or 5B. Typically, after full insertion of bars 5A through insertion apertures 5A, across throat 6, and through insertion apertures 5B, the bars are welded in place to insertion apertures 5A and 5B. In another embodiment, insertion apertures 5A and 5B are eliminated and bars 4A and 4B are affixed to inside diameter 2C of cylindrical sleeve 2A.

Figure 5:
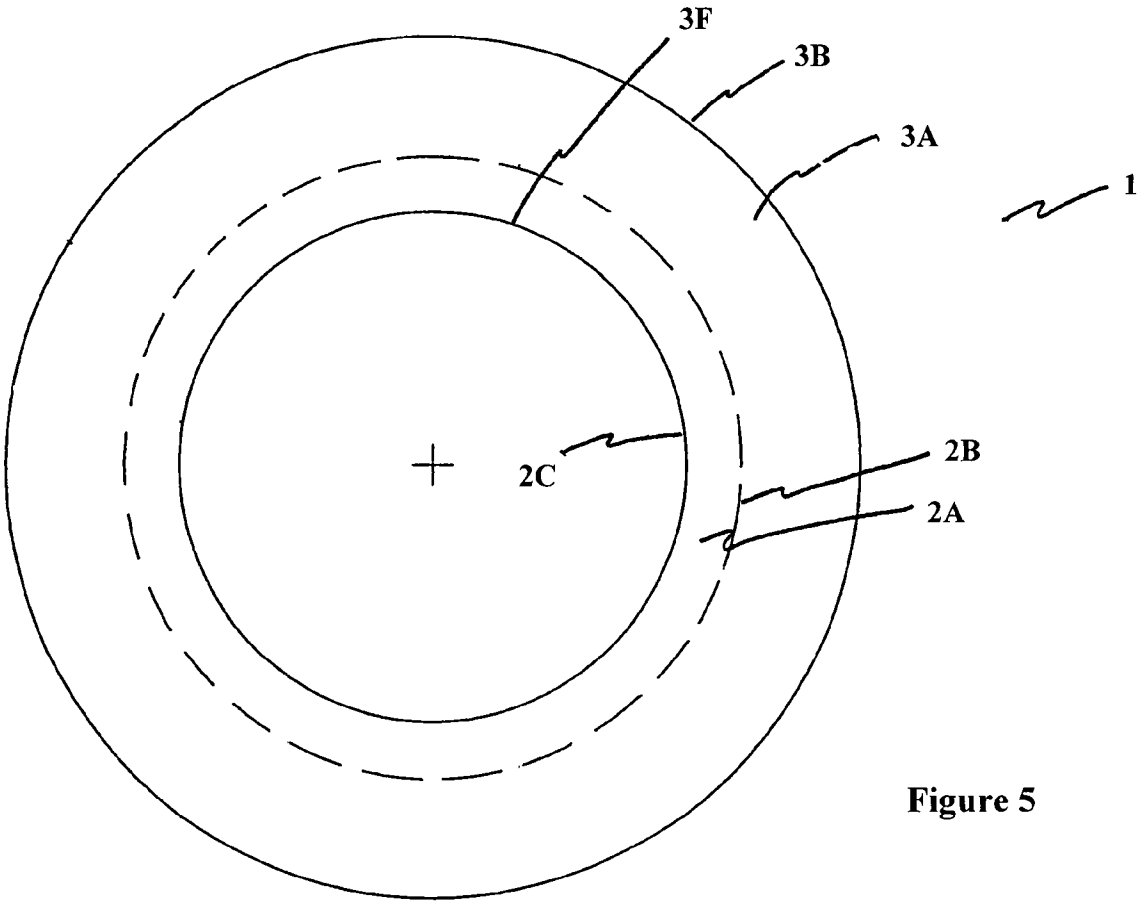
FIG. 5 is a top plan view of another embodiment of guard 1 without grate 4C.
Figure 6:
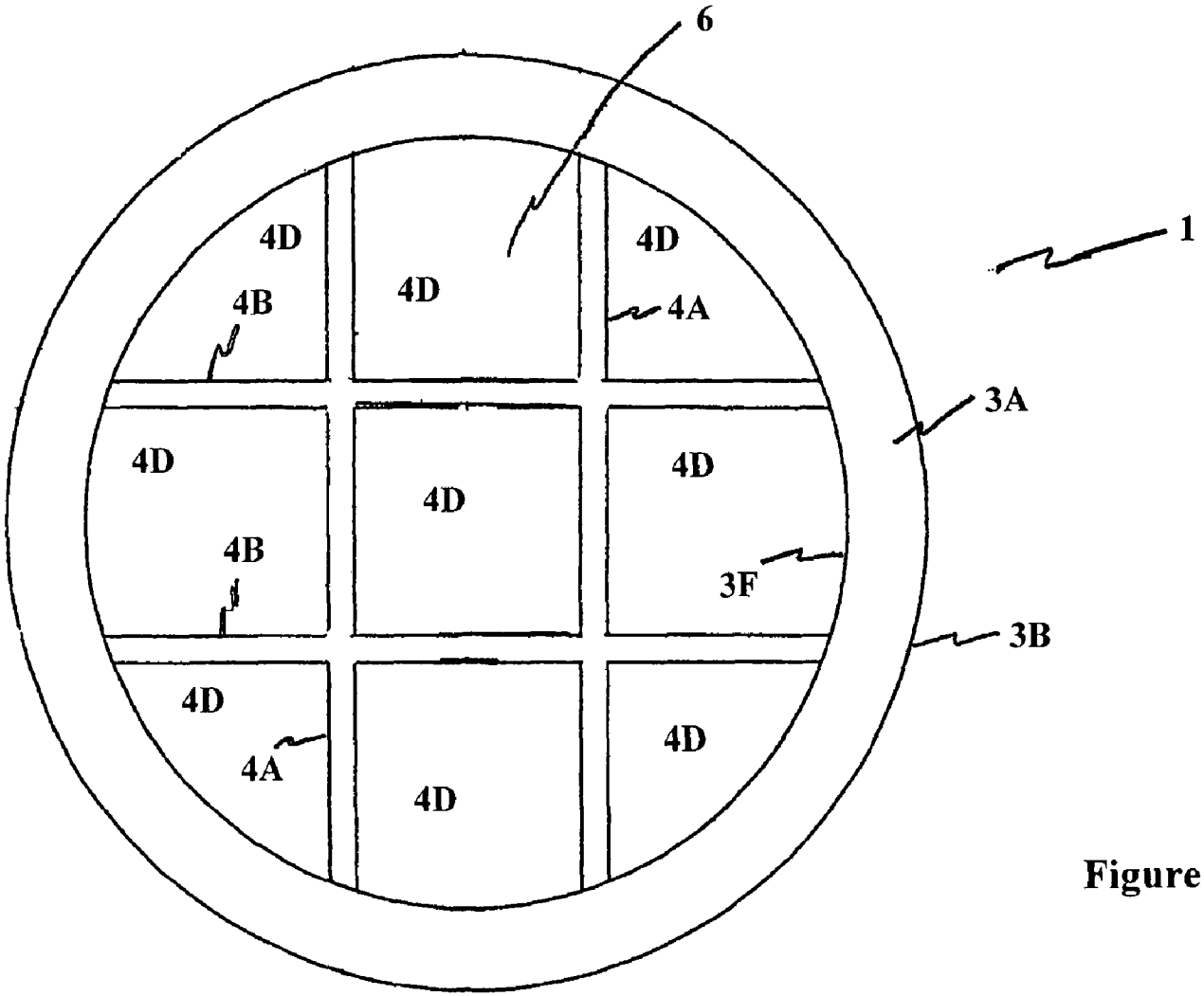
FIG. 6 is a top plan view of another embodiment of guard 1 with bars 4A and 4B arrayed in a flat planar grate, without criss-crossing of bars 4A and 4B.

FIG. 5 illustrates another embodiment of guard 1 ("barless guard 1B") without grate 4C. Barless guard 1B is used with disposal 7 that has a small throat 8A diameter, for example 2¾ inches. Other than having no bars 4A and 4B, barless guard 1B is the same as the embodiment previously described above, i.e., it is comprised of cylindrical sleeve 2A having an outside diameter 2B less than the inside diameter 8B of the throat 8A of disposal 7; and lip 3A extending outward from cylindrical sleeve 2A, lip 3A having an outside diameter 3B greater than the inside diameter 8B of the throat 8A of the disposal 7. Barless guard 1B does not need bars 4A and 4B, because cylindrical sleeve 2A has an inside diameter 2C that is too small for a hand to pass through cylindrical sleeve 2A. An example of this embodiment has an inside diameter 2C of cylindrical sleeve 2A of 2.3 inches, an outside diameter 2B of cylindrical sleeve 2A of 2.8 inches, and an outside diameter 3B of lip 3A of 3.875 inches. An embodiment of barless guard 1B designed to be used with disposal 7 that has a more normal, larger throat diameter, is, for example, approximately 8¼, 7⅝, 6⅝, 6½, 5⅞, and 4⅞ inches. In this embodiment, the thickness of cylindrical sleeve 2A may be made larger to throttle-down inside diameter 2C to the point where a hand will not pass through cylindrical sleeve 2A. Outside diameter 2B of cylindrical sleeve 2A must remain substantially the same as inside diameter 8B of throat 8A of disposal 7 and substantially coaxial with throat 8A of disposal 7 to provide a removable, tight fit between barless guard 1B and disposal throat 8A.

Sanitation is also an issue of great concern in the retail and industrial food preparation arena. It is standard operating procedure in this arena to specify food handling equipment that is easily and quickly cleaned. The equipment must be able to withstand a wash-down with very high temperature (and some times high pressure) water (for removing food from the equipment and for killing bacteria and other pathogens) and caustic cleaning agents. Furthermore, the environment in which guard 1 exists is constantly wet and most materials in such an environment are prone to rusting. Since stainless steel stands up to these conditions it is an excellent material for garbage disposal guard 1. An embodiment of guard 1 is made of stainless steel, which is virtually rust proof. Stainless steel guard 1 is also aesthetically compatible with stainless steel sinks 9, which are often used in industrial food settings. Not withstanding the foregoing about stainless steel, guard 1 may be constructed of any other material, for example, plastic, other steels, other metals, or even wood such as teak.

An embodiment of guard 1 has sufficient weight that it takes a very deliberate step to remove it, thereby enhancing safety. Yet, guard 1 must be removable from throat 8A of garbage disposal 7 for cleaning, removing material stuck in disposal 7, or repair of disposal 7. The most straight forward method of removing guard 1 is to remove it by hand. For safe removal by hand, the open portion of the grate must be of a size that a hand cannot extend through and be injured by the grinding blades of disposal 7. However for easy removal, the open portion of grate 4C must be of a size that is not so small that the user's fingers are unable to grasp grate 4C of guard 1 and pull it out of throat 8A of disposal 7. Moreover, the open portion of grate 4C must not be so small that the typical size of food being disposed of cannot pass through grate 4C.

Garbage disposal 7 may be a stand alone unit that is later attached to an after-market sink 9 and fitted with after-market guard 1. Alternatively, an embodiment of guard 1 comprises garbage disposal 7 manufactured with guard 1 as an integral part of disposal 7. In other words, guard 1 and disposal 7 are a unitary device.

An embodiment of the unitary guarded disposal (FIG. 4) is comprised of a throat 6 of guard 1 through which disposable material is loaded into the throat 8A of disposal 7, a container 10 for receiving loaded disposable material, a means for grinding the disposable material within container 10, an outlet in container 10 for removal of ground disposable material, and guard 1 on the throat 8A of disposal 7.

Moreover, an embodiment of guard 1 is a unitary device comprised of sink 9, disposal 7, and guard 1.

Embodiments of guard 1 are made in different diameters to fit within throat 8A of different sized disposals 7. Guard 1 may be manufactured in various sizes to fit disposals 7 of any brand and of any throat 8A size. Some examples of major manufacturers of garbage disposal units 7 in which guard 1 fits include: Hobart, In-Sink-Erator, Salvajore, Majestic, and Waste King.

Although embodiments of guard 1 can be manufactured to fit throat 8A of any size disposal 7, guards 1 are often made to fit the most common throat 8A sizes of commercially available disposals. The common throat 8A sizes have diameters of approximately 8¼, 7⅝, 6⅝, 6½, 5⅞, 4⅞, 2¾ inches. The outside diameter of cylindrical sleeves 2A are matched to fit the foregoing throat 8A sizes. Enough clearance between the throat 8A sizes and the outside diameters of cylindrical sleeves 2A is allowed for ease of removal and insertion of the sleeves in the throats. A common example of the spacing between stainless steel bars 4A and 4B of grate 4C is 2⅜ by 2⅜, 2¼ by 2⅛, and 1⅝ by 1⅝ inches. A common diameter of bars 4A and 4B is 3/16 inch. Embodiments of guard 1 have lips 3A with an outside diameter 3B of 9¼, 7 9/16, 6½, 3⅞, and 3½ inches. A ½ to ¾ inch lip 3A is usually sufficient for most applications.

As can be appreciated to those skilled in the art, the embodiments are not limited by the above discussion, but only by the claims presented below.

What is claimed is:

1. A disposal system, comprising a garbage disposal and an integral guard, wherein the guard is comprised of (a) a cylindrical sleeve having an outside diameter less than, the inside diameter of the throat of the disposal, (b) a lip extending outward from the cylindrical sleeve, the lip having an outside diameter greater than the diameter of the throat of the disposal, and (c) bars extending between points on the inside circumference of the cylindrical sleeve, wherein a first set of bars, without any of the first set of bars intersecting another bar of the first set, extends in one direction across the inner circumference of the cylindrical sleeve and a second set of bars, without any of the second set of bars intersecting another bar of the second set, extends in a direction across the inner circumference of the cylindrical sleeve so that the second set of bars cross the first set of bars, thereby forming a criss-crossing pattern of bars.

2. The disposal system of claim 1, also comprising a sink.

3. The disposal system of claim 1, wherein the garbage disposal is comprised of (a) a throat through which disposable material is loaded; (b) a container for receiving loaded disposable material; (c) a means for grinding the disposable material within the container; and (d) an outlet in the container for removal of ground disposable material.

4. The guard of claim 1, wherein the outside diameter of the cylindrical sleeve is substantially the same as the inside diameter of the throat of the disposal.

5. The disposal of claim 1, wherein the cylindrical sleeve is substantially coaxial with the throat of the disposal.

6. The guard of claim 1, wherein the bottom of the lip abuts the top surface of the bottom of the sink.

7. The guard of claim 1, wherein the top of the lip is defined by a radius.

8. The guard of claim 1, wherein the top of the lip is angled upward from the outside diameter of the lip to the termination point of the lip at the inside circumference of the cylindrical sleeve.

* * * * *